US010474107B2

(12) United States Patent
Rochat et al.

(10) Patent No.: US 10,474,107 B2
(45) Date of Patent: Nov. 12, 2019

(54) MAGNETIC ANTI-SHOCK SYSTEM FOR A TIMEPIECE ARBOR

(71) Applicant: Montres Breguet S.A., L'Abbaye (CH)

(72) Inventors: Jean-Philippe Rochat, Les Bioux (CH); Benoit Legeret, Le Sentier (CH); Davide Sarchi, Renens (CH); Polychronis Nakis Karapatis, Premier (CH)

(73) Assignee: Montres Breguet S.A., L'Abbaye (CH)

( * ) Notice: Subject to any disclaimer, the term of this patent is extended or adjusted under 35 U.S.C. 154(b) by 0 days.

(21) Appl. No.: 15/564,303

(22) PCT Filed: Apr. 7, 2016

(86) PCT No.: PCT/EP2016/057582
§ 371 (c)(1),
(2) Date: Oct. 4, 2017

(87) PCT Pub. No.: WO2016/166006
PCT Pub. Date: Oct. 20, 2016

(65) Prior Publication Data

US 2018/0136608 A1 May 17, 2018

(30) Foreign Application Priority Data

Apr. 16, 2015 (EP) ..... 15163809

(51) Int. Cl.
*G04B 31/02* (2006.01)

(52) U.S. Cl.
CPC ..... *G04B 31/02* (2013.01)

(58) Field of Classification Search
CPC ..... G04B 31/02; G04B 31/004; G04B 31/00; G04C 3/064
See application file for complete search history.

(56) References Cited

U.S. PATENT DOCUMENTS 5,506,459 A * 4/1996 Ritts ..... A63H 1/00 310/90.5
6,153,958 A * 11/2000 Hull ..... F16C 32/0438 310/90

(Continued)

FOREIGN PATENT DOCUMENTS

DE 100 62 065 A1 3/2002
EP 2 450 758 A1 5/2012

(Continued)

OTHER PUBLICATIONS

International Search Report dated Jul. 8, 2016 in PCT/EP2016/057582 filed Apr. 7, 2016.

(Continued)

*Primary Examiner* — Sean P Kayes
(74) *Attorney, Agent, or Firm* — Oblon, McClelland, Maier & Neustadt, L.L.P.

(57) ABSTRACT

Sub-assembly for watches, including an arbor including a magnetized or electrically charged surface pivoting inside a housing, and a pole piece subjecting this surface to a magnetic or electrostatic field about an axis, one pole piece cooperating axially with this surface to absorb a shock and then return the arbor to an operating position, and creating, in proximity to this surface, a magnetic or electrostatic field, which radially attracts the arbor towards a wall of the housing.

19 Claims, 10 Drawing Sheets

(56) References Cited

U.S. PATENT DOCUMENTS

| | | | | |
|---|---|---|---|---|
| 6,231,011 | B1 * | 5/2001 | Chu | B64G 1/283 244/165 |
| 9,030,070 | B2 * | 5/2015 | Marechal | F16C 32/0408 310/90.5 |
| 9,778,619 | B2 * | 10/2017 | Zaugg | G04C 3/064 |
| 2012/0112589 | A1 * | 5/2012 | Marechal | F16C 32/0408 310/90.5 |
| 2012/0113767 | A1 | 5/2012 | Marechal et al. | |
| 2014/0035411 | A1 | 2/2014 | Kundel | |
| 2015/0234361 | A1 | 8/2015 | Marechal et al. | |
| 2015/0362892 | A1 * | 12/2015 | Zaugg | G04C 3/064 368/168 |

FOREIGN PATENT DOCUMENTS

| | | | |
|---|---|---|---|
| EP | 2 450 759 | A1 | 5/2012 |
| FR | 1 314 364 | A | 1/1963 |
| JP | 56-59027 | A | 5/1981 |
| WO | 2011/095646 | A1 | 8/2011 |

OTHER PUBLICATIONS

European Search Report dated Mar. 3, 2016 in EP 15163809.5 filed Apr. 16, 2015.

* cited by examiner

Fm (N)
h1/h1+h2
0
0.2
0.4
0.6
0.8
1
-0.05
-0.1
-0.15
-0.2
-0.25

Fm (N)
h1/h1+h2
0
0.2
0.4
0.6
0.8
1
-0.01
-0.02
-0.03
-0.04
-0.05
-0.06
-0.07
-0.08
-0.09

MAGNETIC ANTI-SHOCK SYSTEM FOR A TIMEPIECE ARBOR

CROSS-REFERENCE TO RELATED APPLICATIONS

This is a National phase Application in the United States of International patent Application PCT/EP2016/057582 filed on Apr. 7, 2016 which claims priority of the European patent Application 15163809.5 filed on Apr. 16, 2015. The entire disclosure of the above patent application is hereby incorporated herein by reference.

FIELD OF THE INVENTION

The invention concerns a timepiece sub-assembly for a watch, comprising a main structure and an arbor that is pivotably movable about an axis of pivoting inside at least one housing of said main structure, said arbor comprising at least one surface made of a magnetized or ferromagnetic material, or respectively an electrically charged or electrostatically conductive material, and said main structure comprising at least one pole piece arranged to create, in proximity to at least one said surface, a magnetic field, or respectively an electrostatic field, to hold said arbor axially and radially.

The invention also concerns a movement including at least one such sub-assembly.

The invention also concerns a watch including at least one such sub-assembly.

The invention concerns the field of watch movements comprising pivoting mechanical components.

BACKGROUND OF THE INVENTION

In horology, and more particularly for watches, mechanical technology is generally used to hold a component, in particular an arbor, in a particular position. It may be held against a stop by an elastic system, particularly when a certain degree of movement is required in the event of a shock. For example, a spring holds an arbor against a stop.

Retention by a preefforted spring is not stable over time: such a spring, which must work with variations in effort due to shocks experienced by the watch, is subject to fatigue and wear, as is every component which is subjected to impact efforts on the stop.

Further, reproducible fabrication of such a spring is difficult. The set of tolerances may also cause great diversity in the value of the preeffort force. Consequently, performance is not stable over time, and the anti-shock effect also deteriorates over the life of the watch.

In short, the main problems encountered with mechanical retention systems that are elastic are the wear of components caused by repeated mechanical effort, and the need to achieve tight tolerances which are therefore expensive.

It therefore remains difficult to ensure the axial retention of a timepiece arbor, with a durable anti-shock mechanism.

EP Patent Application No 2450758 in the name of MONTRES BREGUET SA discloses a method for orientation of a timepiece component made of magnetically permeable or magnetic material comprising two ends, wherein on both sides of said ends, two magnetic fields are created, each attracting said component onto a pole piece, with an unbalance in the intensity of said magnetic fields around said component, in order to create a differential in the forces thereon and to press one of said ends onto a contact surface of one of said pole pieces, and to hold the other end at a distance from the other pole piece. This Application also discloses an electrostatic variant along the same principle. The Application also concerns a magnetic pivot (or an electrostatic variant) comprising such a timepiece component including a guide device with, at a greater air gap distance than the distance of centres between the ends, surfaces of two pole pieces each arranged to be attracted by a magnetic field transmitted by one of the ends, or to generate a magnetic field attracting one of the ends, such that the magnetic forces exerted on the two ends are of different intensity, in order to attract one of the ends into contact with only one of the pole piece surfaces. In that Patent, the main function of the magnets is the radial recentring of the arbor. The two magnets creating magnetic fields on either side of the arbor, each located at one of the ends, are necessary for its operation.

EP Patent Application No 2450759 in the name of MONTRES BREGUET SA discloses mechanical anti-shock devices associated with a magnetic pivot, and in particular a magnetic (or electrostatic) anti-shock device for the protection of a timepiece component mounted to pivot between a first and a second end. It includes, on either side of these ends, on the one hand, means for guiding the pivoting of or means for attracting the first and held resting on a first pole piece, and on the other hand, in proximity to a second pole piece, means for guiding the pivoting of the second end or means for attracting the second end towards the second pole piece, and the means for guiding the pivoting of or means for attracting the first end on the one hand, and the means for guiding the pivoting of or means for attracting the second end on the other hand, are movable along a given direction between stops.

FR Patent 1314364 in the name of HELD discloses a combination of magnets for magnetic suspension of contactless timepiece pivots, with the combination of an annular magnet in a disc pierced right through the centre. It uses magnetic repulsion to obtain suspension, and thus contactless operation. In a first variant, this magnet is radially magnetized, with one pole on the inner generatrices of the hole, and the other pole on the outer generatrices. In a second variant, this magnet is axially magnetized, the two pole areas being distributed over the two circular plane surfaces of the disc, the arbor of the magnetically held and guided movable assembly passing through the centre of the hole in the annular magnet, the arbor being formed by a tube with thin non-magnetic walls containing a hypercoercive material, magnetized in one piece with two poles of opposite signs at the two ends, or in two segments separated by a gap, the opposite ends of the two segments housed inside the protective tube having poles of the same sign, assembled with a fixed disc/magnet, with radial pole axes and poles of the opposite sign assembled with the axially magnetized disc, the gap separating the two segments forming the core of the tubular arbor being similar to the thickness of the disc concerned and placed inside the central hole in the latter, such that the terminal ends of the axial magnet extend slightly inside the hole, the two plane, circular surfaces delimiting the height of the cylinder or magnetized disc.

DE Patent Application 10062065A1 in the name of SIEMENS, WO Patent Application 2011095646A1 in the name of FERREIRO GARCIA RAMON, and JP Patent Application S5659027A in the name of SEIKO, disclose the use of magnetic repulsion to obtain operation in suspension.

SUMMARY OF THE INVENTION

The invention proposes to define an architecture for holding in position a timepiece arbor, which is capable of ensuring a stable anti-shock resistant effect over time, and which is reproducible.

To this end, the invention concerns a timepiece sub-assembly for watches according to claim 1.

The invention also concerns a movement including at least one such sub-assembly.

The invention also concerns a watch including at least one such sub-assembly.

BRIEF DESCRIPTION OF THE DRAWINGS

Other features and advantages of the invention will appear upon reading the following detailed description, with reference to the annexed drawings, in which:

FIG. 16 B illustrates, in a similar manner to FIG. 16, a variant where in the radial fields generate attraction forces instead of repulsion forces, whereas the axial fields of the structure generate repulsion forces.

DETAILED DESCRIPTION OF PREFERRED EMBODIMENTS

Figure 1:
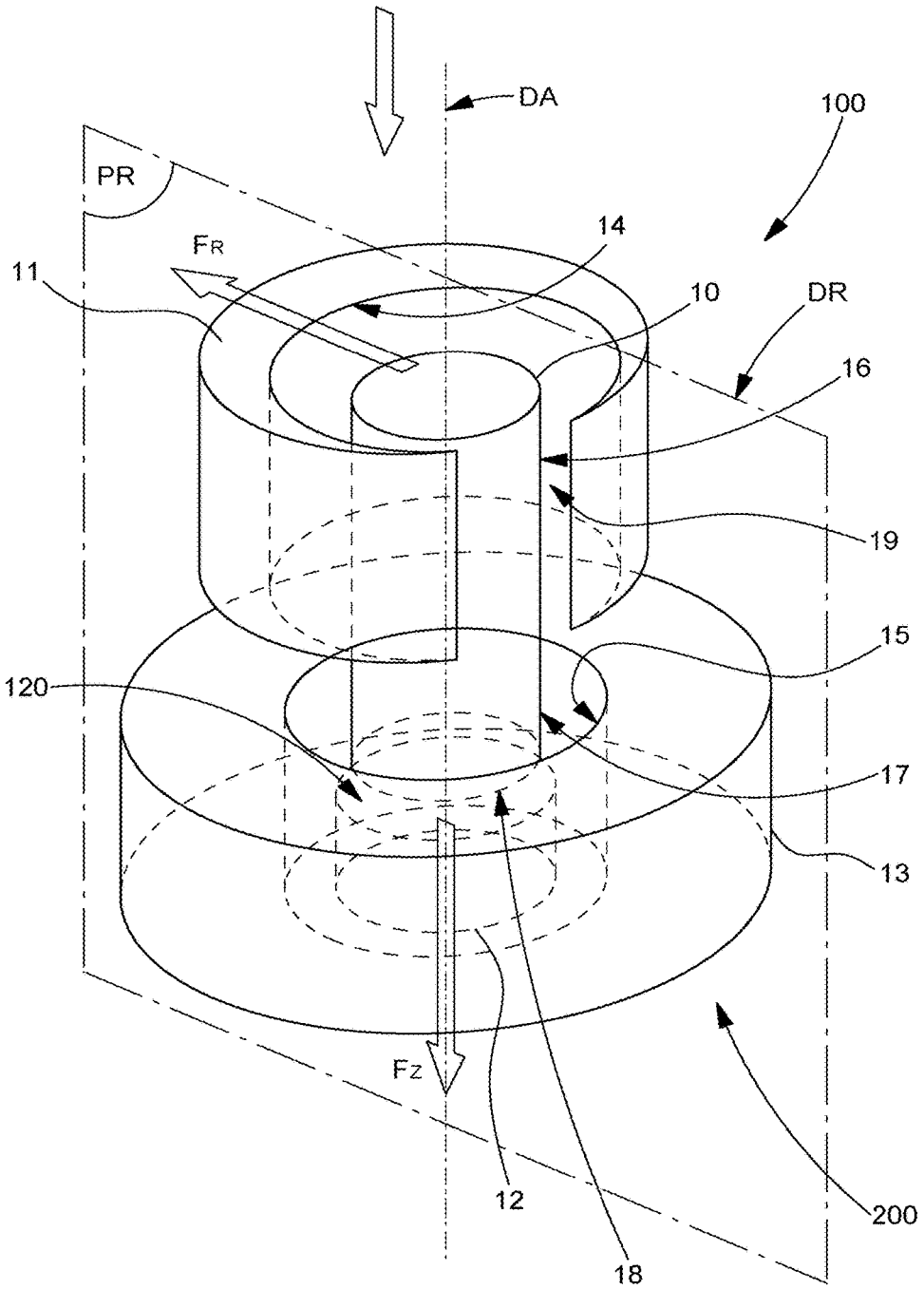
FIG. 1 shows a schematic perspective view of a timepiece sub-assembly according to the invention comprising an arbor which is radially held, by magnetic attraction or repulsion, inside a first bore, by a first pole piece forming a substantially tubular sector, the axis of this arbor is held on an axis of pivoting substantially corresponding to the axis of the first bore; this arbor is axially held by a second front pole piece, inside a chamber defined here by a second bore comprised in a substantially tubular limit sleeve; this sub-assembly is represented without any position stops.

The effects of mechanical efforts in a component depend on a large number of parameters which often have a wide range of tolerances. The consequences of friction and wear are particularly difficult to control, since they depend to a great extent on the surface condition and physical properties of the materials used.

These properties depend in turn on the alloys used and methods implemented, in particular heat, surface and ion implantation treatments. The cumulative tolerances of the different parameters of the methods and materials make it impossible for these physical properties to be known and precisely controlled. Consequently, reproducibility is not ensured, as a result of such tolerances. Moreover, reducing the range of tolerances, which makes it possible to obtain better reproducibility of phenomena, result in costs that are too high for mass production.

The theory determining magnetic interactions is fully described by the Maxwell equations, and the remaining unknowns arise from the magnetic materials used, which are increasingly better controlled, and from the difficulty in solving these equations analytically and numerically with the lowest possible approximations. However, from a macroscopic point of view, these inaccuracies are sufficiently low to make magnetic systems intrinsically reliable.

The invention proposes an anti-shock retention system for a timepiece arbor, that is stable over time, under the effect of a magnetic and/or electrostatic field.

It is more particularly described with non-limiting examples of a magnetic application. The invention can also be implemented by employing electrostatic fields, particularly through the use of electrets. Or even by combining magnetic fields and electrostatic fields.

An "arbor" here means any timepiece component arranged to pivot about a theoretical axis of pivoting. The invention is described here essentially for the shaft-like portions of such a component, or wheel set or suchlike. For example, in the case of a balance wheel, particular emphasis will be placed on the ends of the shaft-like portion of the balance wheel. The invention is illustrated in a simplified manner with an arbor of revolution comprising one or more cylindrical shoulders. However, this illustration is not limiting; the invention can apply to any type of component, such as a pallet-lever, escape wheel, wheel, pinion or other element.

It is proposed, in these examples, to use magnetic forces to construct an arbor holding system, utilising the forces induced on a piece of magnetized material immersed in a magnetic field. This force is given (for the interaction between a magnet and a magnetic part) by the following law:

$$F=(M\cdot\nabla)B \tag{1}$$

where M is the magnetization of the material and B is the external magnetic field, and all the quantities in (1) are vectors.

The principle is to position one or more magnets on a fixed part, and to utilise the magnetic force to which a ferromagnetic (attraction), diamagnetic (repulsion) or paramagnetic (attraction) component—which must be fixed—is subjected. This component is thus subjected to a force of attraction or repulsion, which can be utilised to hold it in place.

Figure 2:
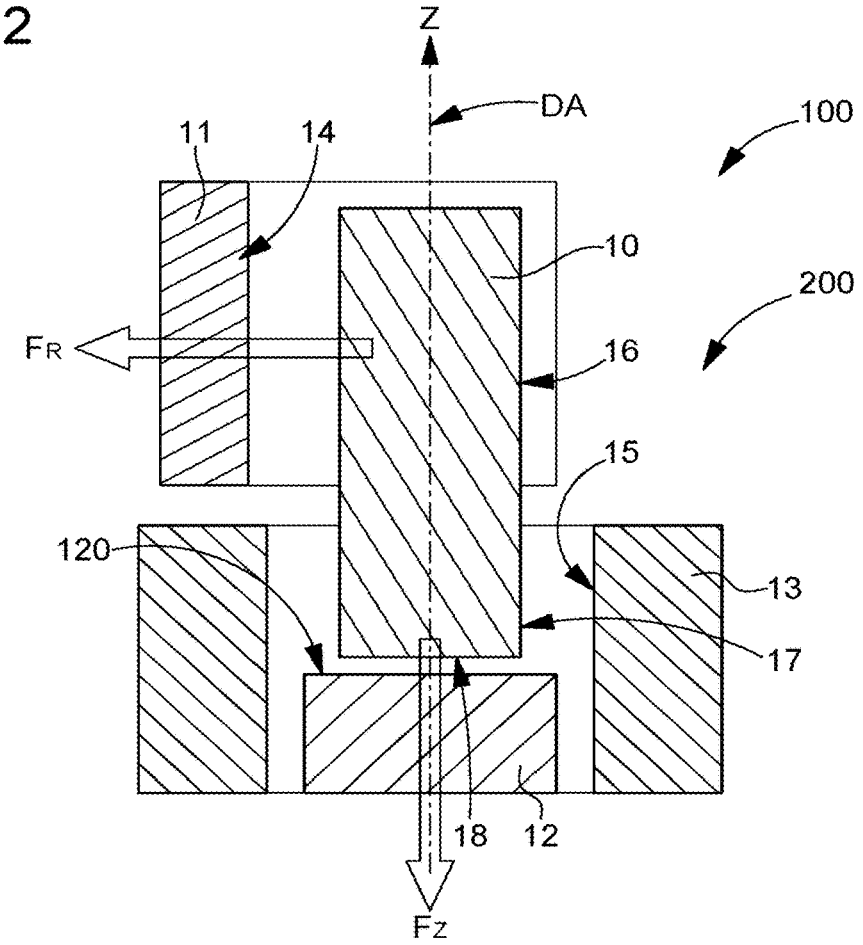
FIG. 2 shows a schematic, cross-sectional view of the sub-assembly of FIG. 1.
Figure 3:
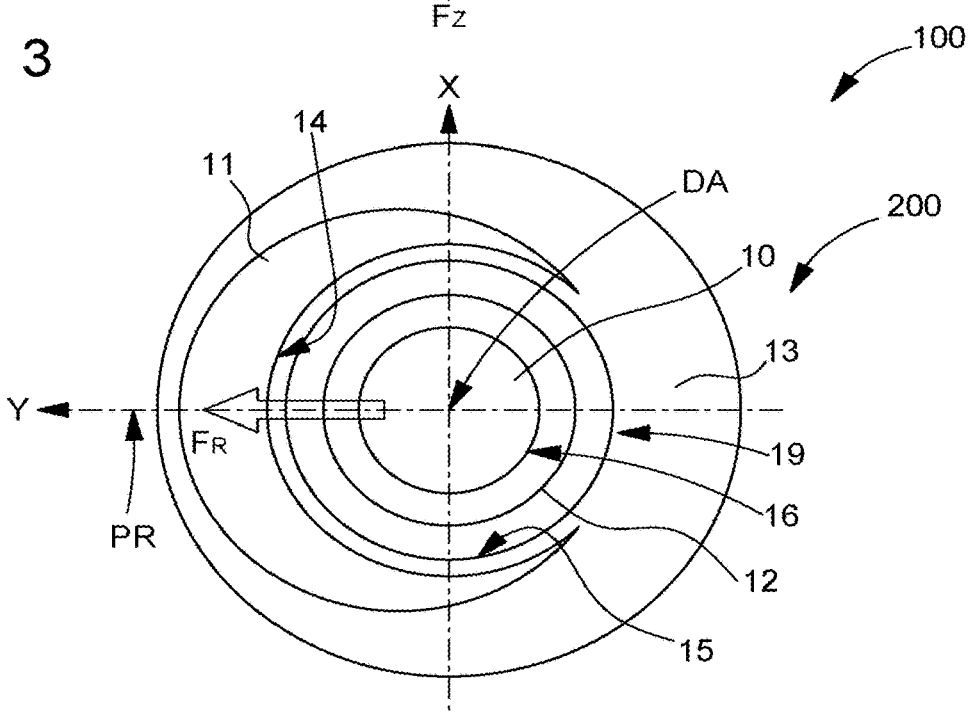
FIG. 3 shows a schematic, top view of the sub-assembly of FIG. 1.

A first variant, in FIGS. 1 to 3, consists in using the magnetic force to effort an arbor in three directions, for example by holding it in contact inside a triangle that positions it (position stops). The contact may also be made directly on the permanent magnets.

Figure 4:
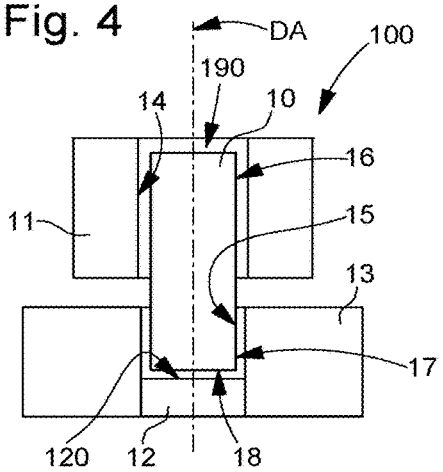
FIGS. 4 and 5 represent, respectively in a cross-sectional and top view, another similar sub-assembly, wherein the first pole piece is of revolution about the arbor.

A second variant, in FIG. 4, with radial mechanical guiding and a magnet that ensures axial holding, concerns cases where the magnetic force is used to effort an arbor in one or two of the three directions, whereas mechanical guiding is used to limit its movement in the other directions. Typically, the radial guiding can be achieved via a sleeve, while the arbor is held axially by a magnet.

The number of magnets used may, of course, change from one variant to another. A design may be envisaged, for example, which uses a crown of several magnets instead of a single magnet for axial holding at z in FIGS. 1 to 4. This has the advantage of averaging out defects in the components, and of exerting the effort, particularly the force, over a greater radius.

In the magnetic application described below, there is produced a holding system that utilises efforts in the broad sense, i.e. forces or torques, induced on a piece of magnetized material or ferromagnetic material immersed in a magnetic field. This effort depends on the magnetization of the material, or on its magnetic permeability, and on the intensity of the local magnetic field. In a particular embodiment, one or more magnets are positioned on a fixed part called the structure, and/or on the arbor. This arbor is subjected to (or generates, in the case where it is magnetized and cooperates with a magnetized or non-magnetized or ferromagnetic environment) a force of attraction or of repulsion which can be used to hold it in place.

For light elements, and if the available space allows the presence of one or more magnets capable of generating a sufficient magnetic field, the magnetic force alone may be sufficient to retain an element in the event of shocks.

Figure 6:
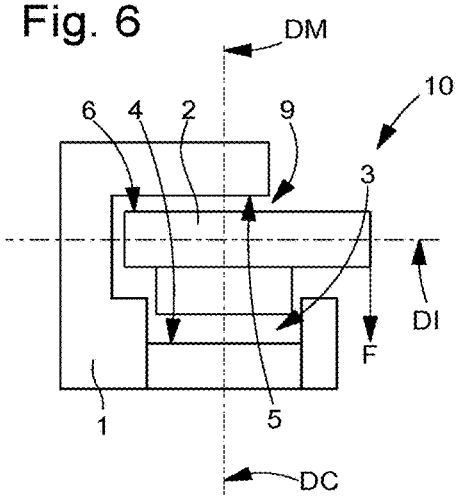
FIG. 6 shows a schematic cross-sectional view of a sub-assembly for a watch exterior or movement according to the invention, in a first variant which includes a radial mechanical guiding system, and at least one magnet which ensures the axial holding of an arbor in an axial direction; this sub-assembly comprises a structure with a lower wing comprising a magnet at the bottom of a housing; this housing receives an arbor, which is subjected to a magnetic force of attraction in a field direction parallel to the axial direction; the structure comprises an upper wing, limiting the displacement of the insert and forming a safety stop above the arbor.
Figure 7:
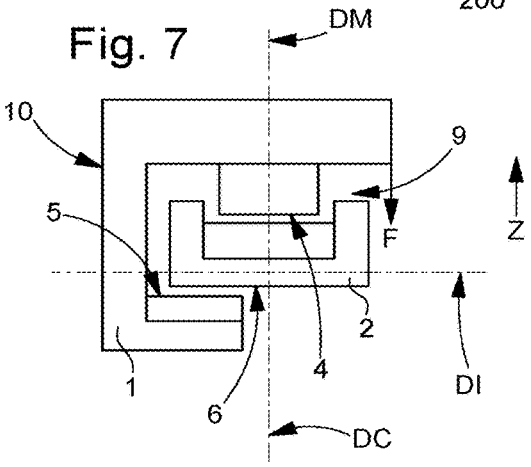
FIG. 7 represents, in a similar manner to FIG. 1, a reverse configuration, wherein the safety stop is below the arbor, and wherein a tribological surface is added to the stop.

However, in most cases, this force is too low. When the magnetic force is too low to resist a shock, it is possible to introduce a safety stop to limit excessive displacement, as seen in FIGS. 6 and 7, which represent two configurations of the FIG. 4 type, with a safety stop, once above the component and once below, and potential contact areas referenced 5. The magnetic hold is thus to used to counter low shocks, with an amplitude limit after which the component moves away and goes to the stop. This operating mode has the advantages of retention systems using springs, while causing a lower shock on the return to position. Indeed, the magnetic system, unlike the spring system, exerts a force that decreases as the part moves away from its held position. The energy stored during an accidental shock (which is released when the component returns to position) is thus lower.

Figure 20:
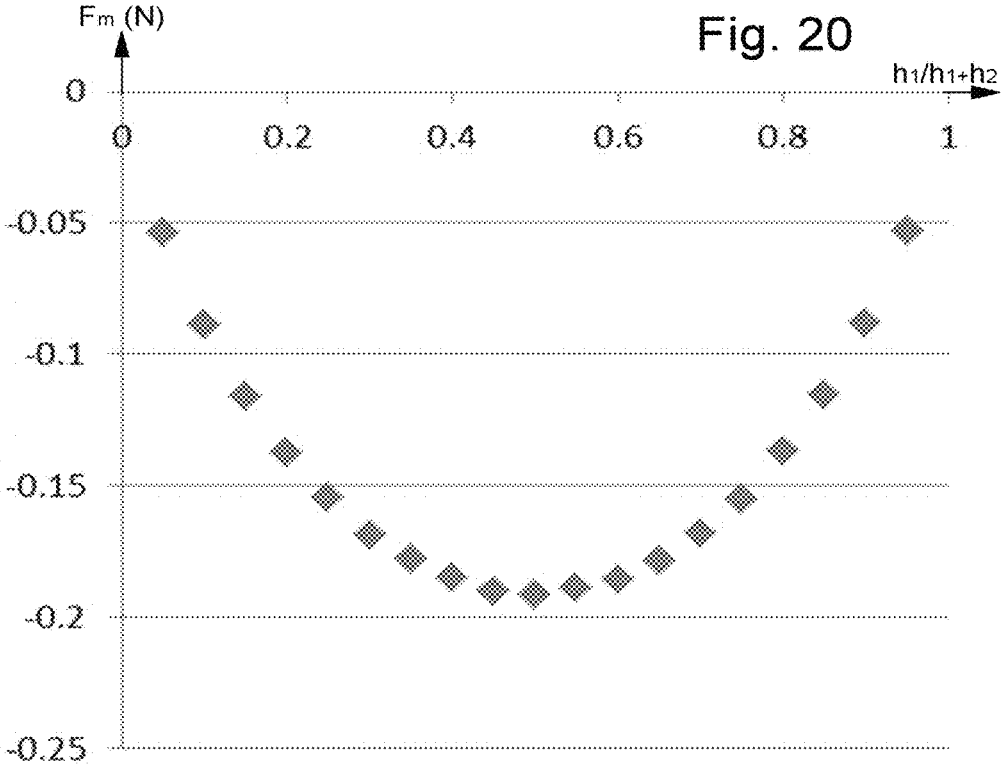
FIG. 20 is a curve showing the magnetic force exerted between two cylindrical magnets of the same power and diameter on the ordinate, as a function of the ratio of their relative heights on the abscissa, the value 0.5 corresponding to the case where they are of the same height.
Figure 21:
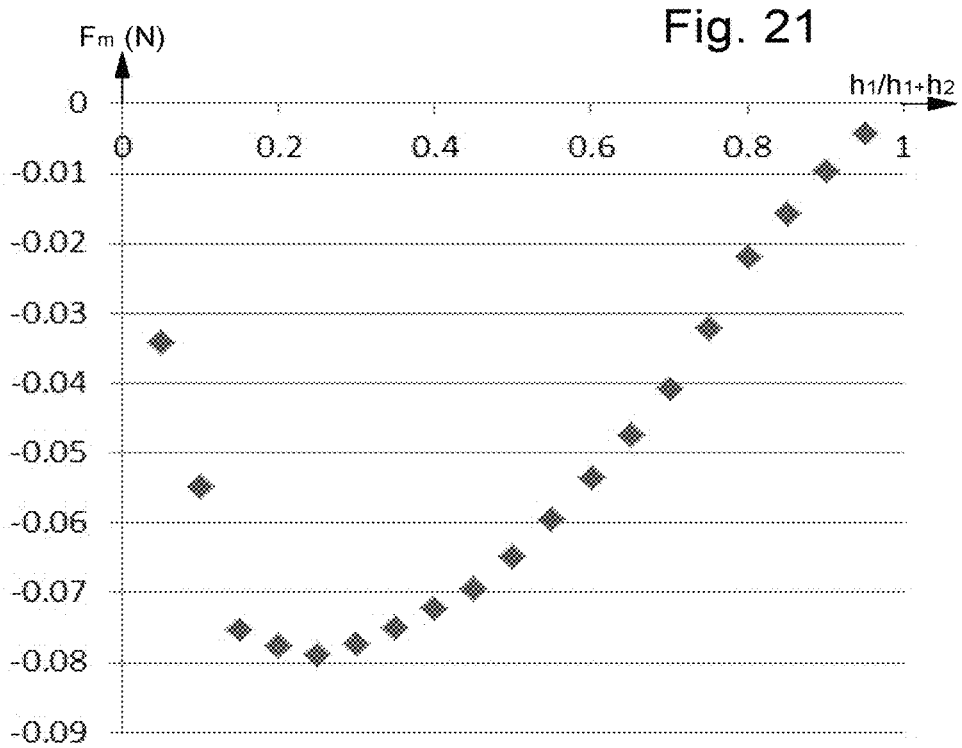
FIG. 21 is a curve showing the magnetic force exerted between a cylindrical magnet and a cylindrical ferromagnetic part of the same diameter on the ordinate, as a function of the ratio of their relative heights on the abscissa, the value 0.25 corresponding to a ferromagnetic part three times smaller than the magnet.

The force can also be generated by two magnets. FIGS. 20 and 21 show the magnetic force Fm in Newtons, capable of being generated by a system with two magnetic bodies, respectively with two magnets in FIG. 20, or with one magnet and a ferromagnetic part in FIG. 21, according to the ratio h1/h2 of the relative size of these two bodies.

Figure 10:
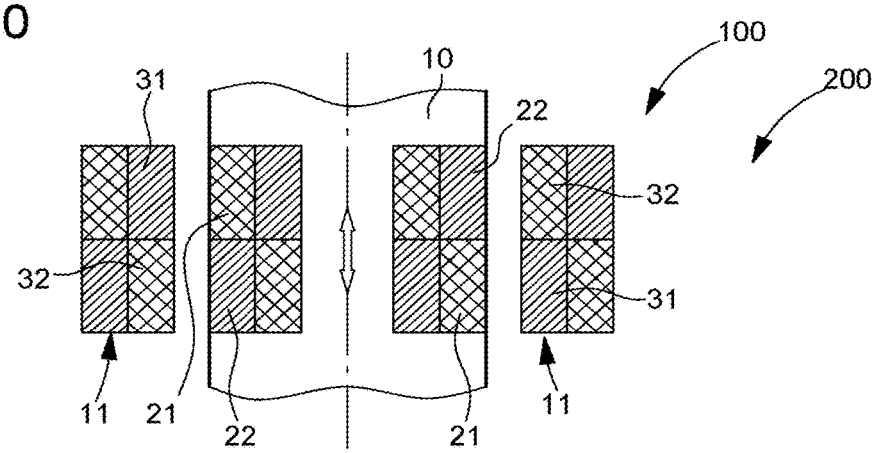
FIG. 10 shows a schematic, partial, cross-sectional view along its axis, of an arbor comprising several magnets, whose polarity is represented by hatching or cross-hatching, and which is movable between other fixed magnets comprised in a structure inside which the arbor can move.
Figure 11:
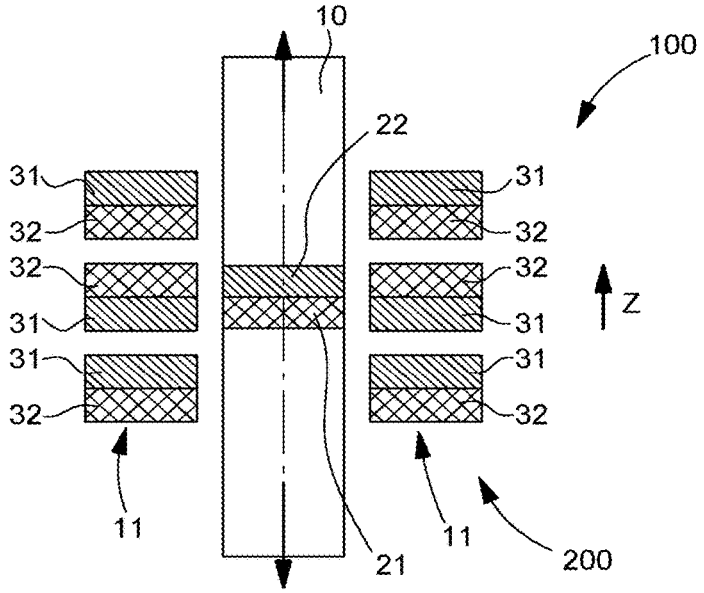
FIG. 11 represents another configuration of an arbor carrying magnets between other fixed magnets of the structure.

In an additional variant, the magnetic system not only has a holding function, but also facilitates the positioning/repositioning function, as seen in FIGS. 10 and 11. In the first case of FIG. 10, an additional force must be applied to overcome the magnetic repulsion of the magnets, and, once the system is in place, it is held there in the axial direction z; such a system is particularly advantageous when combined with the introduction of jewels, or any other tribological surface, to minimise the friction from radial contact. The second case of FIG. 11 is a magnetic recentring system, wherein the arbor, including permanent magnets, is held against a line-shaped structure composed of magnetically attractive parts and repulsive parts. These parts may also be made of permanent magnets. The radial holding of this system is magnetic by means of the attractive parts (with the possible variants presented above); the component is recentred magnetically after each shock. This system can easily be adapted for an angular degree of freedom.

Figure 12:
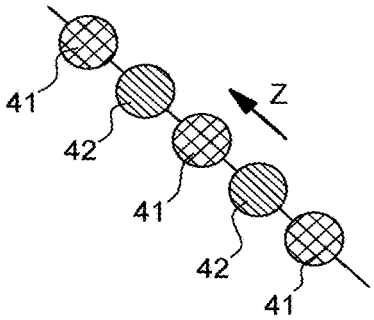
FIG. 12 shows a schematic, partial, cross-sectional view of a line-shaped structure fixed in a direction z, including an alternate arrangement of, on the one hand paramagnetic or ferromagnetic parts, and on the other hand, diamagnetic parts, respectively represented by hatching and by cross-hatching, along which structure, which is immobile, a cylindrical arbor comprising a permanent magnet (not shown) can be aligned.
Figure 13:
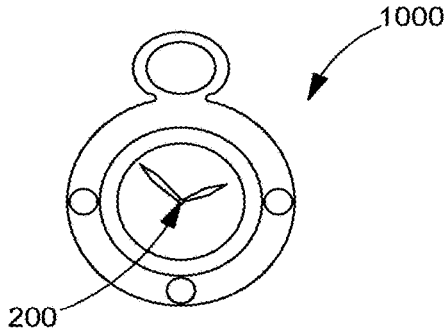
FIG. 13 shows a schematic front view of a watch comprising a movement which comprises such a sub-assembly.
Figure 14A:
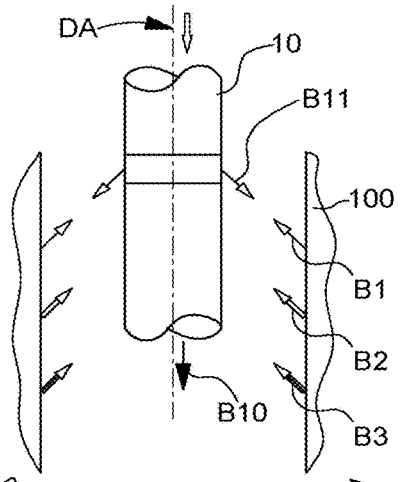
FIG. 14 shows a schematic, partial, cross-sectional view passing through the axis of pivoting of its arbor, of a timepiece assembly according to the invention, comprising an arbor that is pivotably movable inside a structure, wherein the arbor generates an axial field at a lower end, and a substantially conical field about the axis of pivoting with a first intensity in the direction of the axis of pivoting, and wherein the structure inside which the arbor can move comprises a succession of areas generating conical fields, tending to oppose the fields generated by the arbor, and which, from an operating position of the arbor illustrated in FIG. 14A, are of gradually increasing intensity as they approach the lower part of the travel of the arbor; each of these field areas of the structure forms a virtual catch, which brakes the arbor in its downward travel.
FIG. 14B shows the sub-assembly of FIG. 14A after a shock or high acceleration, the arbor starting a travel towards a lower end-of-travel (not represented), and in a position in which the arbor crosses a first field barrier symbolised by the single arrows, which is substantially symmetric and opposite to the conical field of the arbor itself, and in which the arbor arrives at a second field barrier, of higher axial intensity than that of the first barrier, and symbolised by double arrows.
FIG. 14C shows the same sub-assembly in the case where the kinetic energy imparted to the arbor is high and enables it to cross the second field barrier, and where the arbor arrives at a third field barrier, of higher axial intensity than that of the second barrier, and symbolised by triple arrows, and which, in this example, is sufficient to stop the axial travel of the arbor.
FIG. 14D shows the subsequent ascent of the arbor to its operating position of FIG. 14A under the action of the repulsive fields to which it is subjected.
Figure 14B:
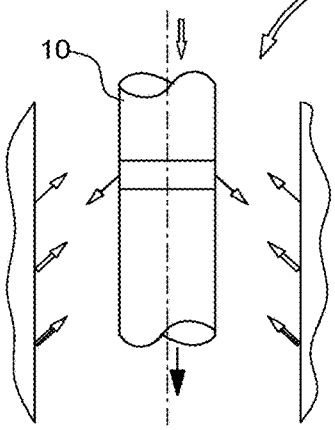
Figure 14D:
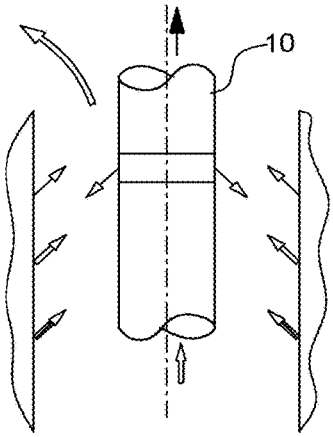
Figure 14C:
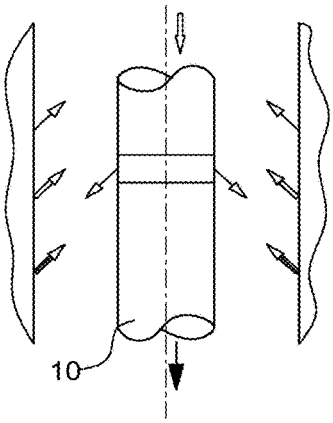
Figure 15A:
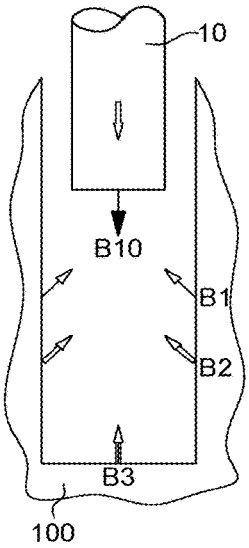
FIG. 15 illustrates, in the same manner as FIG. 14, a similar arrangement, but wherein the arbor only generates an axial end field, and wherein the third conical barrier at the lower end of the travel is replaced by an axial field barrier of similar intensity, and a sequence of descent and ascent of the arbor on its axis which is similar to that of FIG. 14.
Figure 15B:
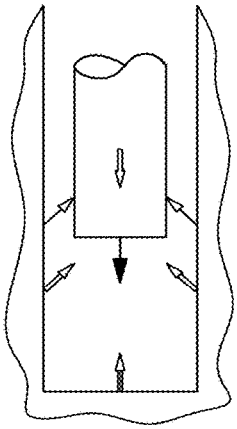
Figure 15C:
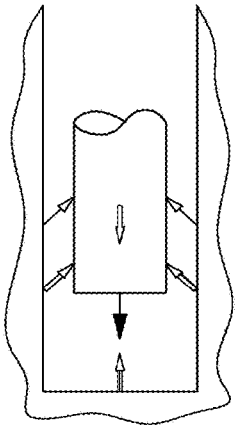
Figure 15D:
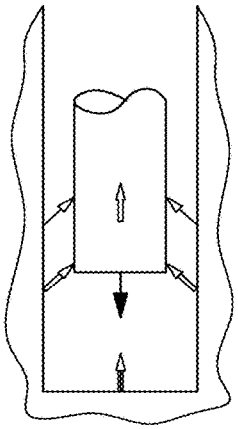
Figure 17A:
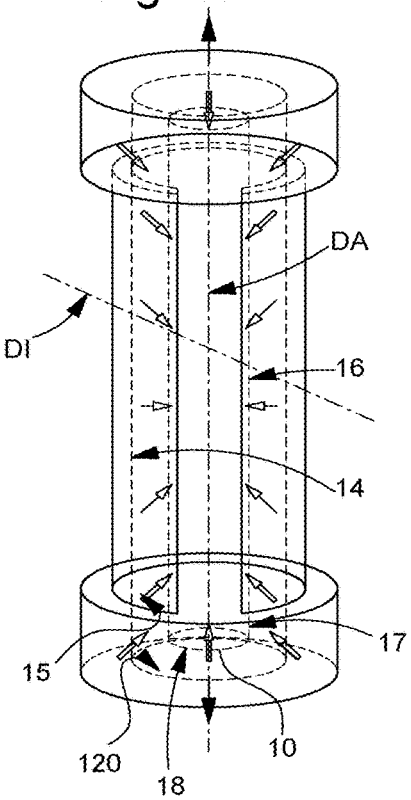
FIG. 17 illustrates, in perspective in view 17A and in a top view in view 17B, a sub-assembly according to FIG. 16, comprising a lateral cutout parallel to the axis of pivoting of the arbor and allowing the insertion and removal of the arbor.
Figure 17B:
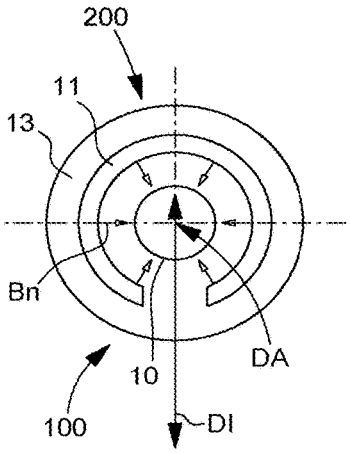

The line-shaped structure of FIG. 12, with magnetically attractive and repulsive areas, may also be directly on the arbor, with a permanent magnet on the fixed part of the movement.

Different geometric configurations can thus be used.

It is also possible to use the magnetic force to effort an element of the watch exterior or movement in the three directions, for example by holding it in contact in a female trihedron that positions it, and which also forms a set of position stops. The magnetic elements may be set back with respect to the contact surfaces. Contact may also be made directly on the surfaces of magnetic components.

One variant concerns cases where the magnetic force is used to effort an element in one or two of the three directions, whereas mechanical guiding is used to limit its displacement in the other directions.

Thus, the invention is more precisely described with regard to the axial damping of an arbor. The pivoting of the arbor may be conventional, by guiding in a jewel or a bearing, or of the magnetic or other type, in particular a combination thereof.

For each of these variants, when the magnetic force is too low to resist a shock, it is possible to introduce a safety stop, to limit the displacement of the arbor and avoid an excessive travel. The magnetic hold is thus used to counter low shocks, with an amplitude from which the magnetically held arbor moves away and meets a mechanical safety stop. This operating mode has the advantages of retention systems using springs, while causing a lower shock on the return to position. Indeed, the magnetic system, unlike the spring system, exerts an effort which decreases as the arbor moves away from the operating position, in which it is held. The energy stored during an accidental shock, and which is released when the element returns to position, is thus lower.

In an advantageous embodiment of the invention, the cooperation between the magnetic and/or electrostatic fields present in the structure and/or the arbor is sequenced, and includes electromagnetic barriers which depend on the relative position of the arbor and of the structure, and the crossing of which uses all or part of the kinetic energy of the arbor in the event of a shock.

The relative effort may be generated by two magnets, or by one magnetic in proximity to a ferromagnetic (attraction), diamagnetic (repulsion) or paramagnetic (attraction) part.

The arbor to be held in place may actually be ferromagnetic, diamagnetic or paramagnetic and be located in proximity to a magnet, or actually comprise one or more magnets or magnetized areas, or respectively electrically charged areas.

In the case where the effort is produced by two magnets, the latter may work by attraction or repulsion, the work by attraction theoretically results in slower ageing of the magnetic system. The repulsion mode is, however, easier to implement for damping at the end of the arbor, and this non-limiting mode is described in the illustrated examples.

The damping features of the invention, by magnetic or electrostatic means, are good for shocks of low or medium amplitude. If it is envisaged to use this technology to completely absorb the extra kinetic energy of the arbor in the event of a shock, it is clear that this will be to the detriment of space. Thus, the invention is preferably combined with a conventional mechanical stop, which may be a simple stop, or a bearing surface of a spring which is not in contact with the arbor during shocks of low or medium amplitude. Preferably, every magnet surface is protected, because of its fragility, by another surface comprised, depending on the case, in the arbor, or in the structural element concerned. Thus, the contact between opposing components, such as a main structure 100 and an arbor 10, may be a contact of one part of the arbor to be held against a position stop, which is not necessarily magnetic.

Figure 16:
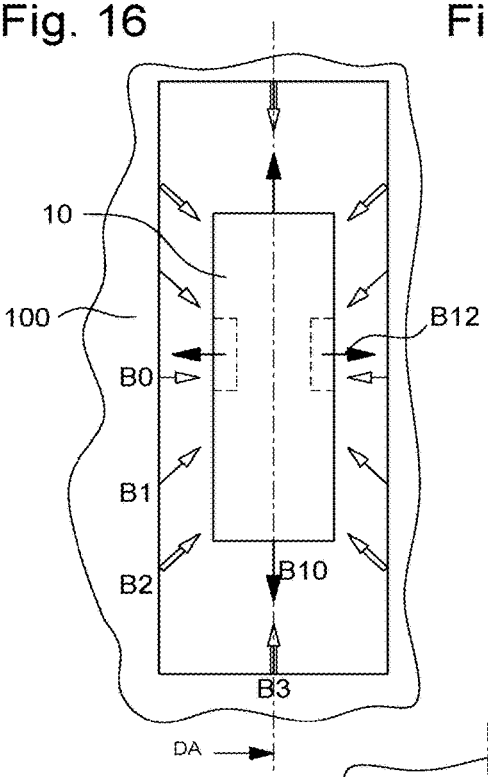
FIG. 16 illustrates a structure comprising a housing in which an arbor can move, with, at the lower and upper ends of the arbor and of the housing, a symmetrical arrangement corresponding to the variant of FIG. 15.
Figure 16A:
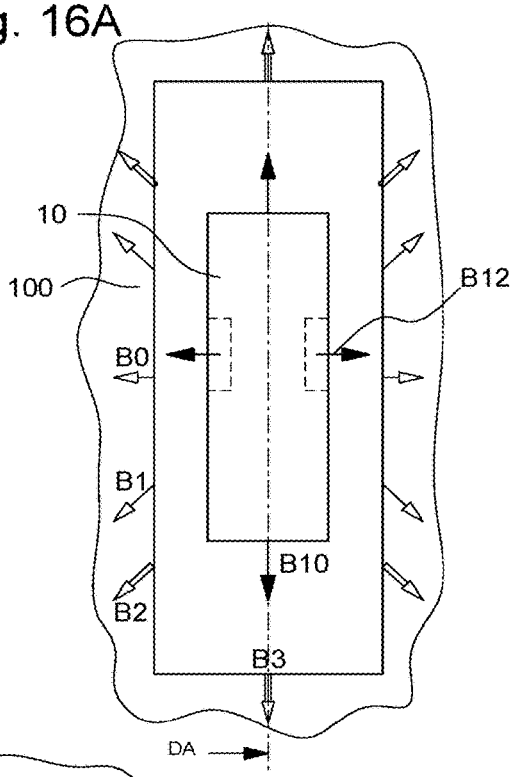
FIG. 16A illustrates, in a similar manner to FIG. 16, a variant wherein the fields generate attraction efforts instead of repulsion efforts.
Figure 16B:
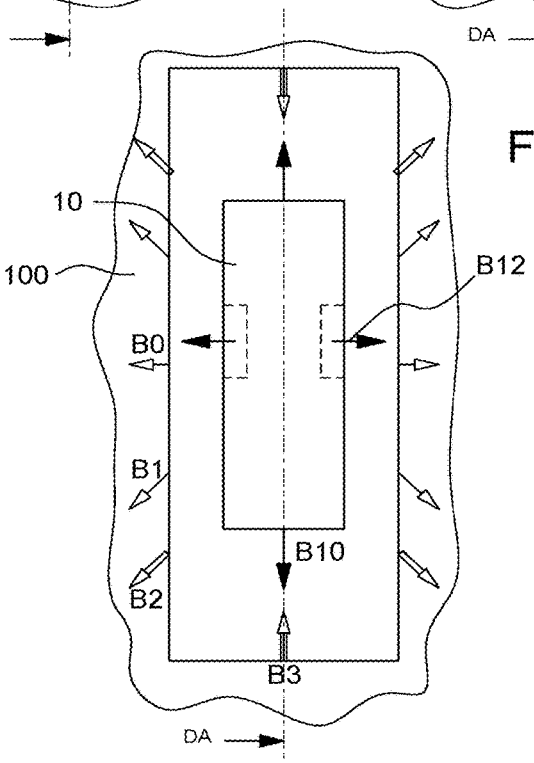

In a preferred application of the invention, the magnetic or electrostatic means, which are implemented to form an axial anti-shock system for the arbor, are also used to ensure axial holding of the arbor in its operating position. It is clear that the contacts are completely avoided only in configurations using magnetic repulsion, as in FIG. 16. In most other cases, even working in magnetic repulsion, a contact on the arbor is inevitable. Circumferential friction dissipates more energy than friction on the front part.

The invention is particularly well suited for holding the arbor in contact, both axially and radially. The configuration with remote axial and/or radial holding of the arbor, which is advantageous in terms of friction, cannot always be implemented.

It is noted in this regard that magnetic or electrostatic cooperation between the arbor and the receiving structure is not necessarily only axial.

Advantageously, this cooperation ensures radial holding, to permanently tend to align arbor 10 on its theoretical axis of pivoting DA. Consequently, even if the conventional guiding of the pivoting of arbor 10 is not perfect, this guiding is optimised by the effect of the magnetic or electrostatic fields which tend to permanently realign arbor 10 on its axis DA.

Figure 8:
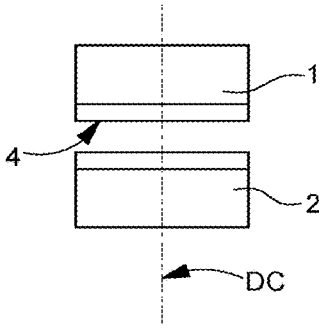
FIG. 8 shows a schematic cross-sectional view of a magnet and a magnetically attractive part forming a structure and an arbor each comprising, on their respective contact surfaces, a tribological or wear resistant layer.
Figure 9:
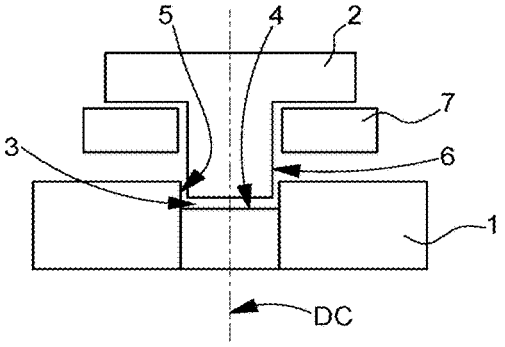
FIG. 9 shows a schematic cross-sectional view of a structure with a magnetized housing receiving a magnet in the shape of a flat head nail, which presses a spacer forming part of an arbor and which is confined and pressed onto the structure by the magnet, clamped between the head of the magnet and the fixed element.

In FIGS. 1 to 4, the contact is not represented; this contact may be of the magnet directly against the arbor (or of the fixed magnet against the magnet of the part to be held in contact where appropriate), as in FIG. 8, or of a part of the component to be held against a position stop (which is not necessarily magnetic), as in FIG. 9. The surface against which the contact is maintained may be adapted to optimise its tribological and mechanical properties.

In an alternative to the conventional guiding of the arbor inside the structure, by means of contact surfaces, these surfaces may be adapted to optimise their tribological and/or mechanical and/or anti-wear properties. A surface layer, as seen in FIG. 8, also achievable with the variant of FIG. 9, or others, may, for example, consist of corundum, diamond or a protective coating. This surface layer may also be made of a material combining particular tribological and magnetic properties, such as tungsten carbide, particularly with a cobalt binder.

For light elements, and if the available space allows the presence of one or more magnets capable of generating a sufficient magnetic field, the magnetic force alone may be sufficient to retain an element in the event of shocks.

Different geometric configurations may be used. In the illustrated examples, the magnetic efforts (forces and/or torques) are used to construct an arbor holding system, utilising the efforts induced on a piece of magnetized material immersed in a magnetic field. To achieve this, one or more magnets are preferably positioned on a fixed part, and use is made of the magnetic effort, to which a ferromagnetic (attraction), diamagnetic (repulsion) or paramagnetic (attraction) part—which must be fixed—is subjected. This component will therefore be subjected to a force of repulsion or attraction which can be used to hold it in place. The reverse relative positioning is also possible.

A variant represented in FIGS. 1 to 3 consists in using a magnetic force to effort an arbor 10 in the three directions, for example by holding it inside a trihedron which positions it, or in contact by position stops (not represented), and/or by magnetic interaction with permanent magnets. For example, any arbor 10 cooperates with a first structure 11 which radially surrounds a first upper shoulder 16 of the arbor, and with a second structure 12 in its axial alignment on axis of pivoting DA. In a particular case, this first structure 11 and second structure 12 are magnets. A third structure 13 includes a bore 15 which limits the radial movement of a lower shoulder 17 of arbor 10.

Figure 5:
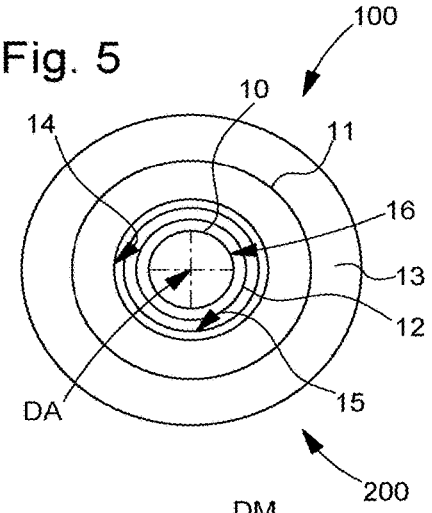

Another variant, represented in FIGS. 4 and 5, illustrates cases where the magnetic force is used to effort an arbor 10 in one or two of the three directions, here in the axial direction corresponding to axis of pivoting DA, whereas mechanical guiding is used to limit the displacement of arbor 10 in the other directions. Typically, radial guiding can be effected by a sleeve, in a bore 14 of a first structure 11, whereas arbor 10 is held axially by a magnet comprised in a second structure 12.

The number of magnets used may, of course, change from one variant to another. A construction including a crown of several magnets, instead of a single magnet for axial holding in the axial direction, in the examples of FIGS. 1 to 5, thus has the advantage of averaging out defects in the components, and of exerting the effort over a wider radius. This may be an advantage if the mechanism is arranged to utilise eddy current dissipation, to increase the friction capabilities of a magnetic equivalent of a friction spring.

The preferred but non-limiting solution, thus uses a magnetic force of attraction, either between two magnets, or between a magnet and a magnetically conductive, notably ferromagnetic, part. It provides better stability and better position control of the parts.

It is understood that equation (1) is only valid to determine the force between a magnet and a magnetic part (it is not valid to determine the force between two magnets), and, in most cases, the magnetic part is ferromagnetic, and will therefore be magnetized in conformity with the magnet: in such case, the force is attraction. Only in the case where the magnetic part is diamagnetic, is there a force of repulsion between the magnet and the component, but this force is ten to a hundred times lower than that which can be obtained with attraction.

The solutions illustrated in FIGS. 1 to 4 only use the force of attraction, the direction of the forces tends to move the pieces closer together, the force is negative, both in the magnet-ferromagnetic part variant, and in the variant with two magnets.

Only FIG. 5 corresponds to a solution where the forces of attraction and repulsion are combined to stabilise the position of the component.

The solutions using repulsion allow all or part of the energy from shocks to be dissipated by magnetic repulsion rather than mechanical shock.

For light arbors, and if the space available allows for the introduction of a sufficient number of magnets, the magnetic effort alone may be sufficient to retain an arbor in the event of shocks. However, in most cases, this effort, limited by space constraints, is too low. When the magnetic effort is too low to resist a shock, it is possible, as seen in FIG. 6 or 7, to introduce a safety stop to limit excessive displacement. These two configurations show a safety stop, once above the component in FIG. 6, and once below in FIG. 7. The magnetic hold is thus preferably used to counter low shocks, with an amplitude limit, after which the component is released from the magnetic influence, and reaches a mechanical stop under the effect of the rest of its kinetic energy. This operating mode has the advantages of retention systems using springs, while causing a lower shock on the return to the normal operating position. Indeed, the magnetic system, unlike the spring system, exerts a effort which decreases as the arbor moves away from the operating position, in which it is held. The energy stored during an accidental shock, which is released when the component returns to position, is thus lower.

In FIGS. 1 to 5, the contact is not represented. This contact may be a direct contact of the magnet with the arbor, as in FIG. 8, or of one part of the arbor to be held against a position stop (not necessarily magnetic) as in FIG. 9. The surface against which the contact is maintained may be adapted to optimise its tribological and mechanical properties. The surface may, for example, be corundum, diamond, sapphire or a protective coating. This surface may also be a material combining advantageous tribological and magnetic properties, such as tungsten carbide with a cobalt binder.

In another variant, the magnetic system has this holding function, and also facilitates the positioning/repositioning function, as seen in FIGS. 10 to 12.

In the first case of FIGS. 10 and 11, upon axial insertion of the arbor in a bore of the structure, an additional effort must be applied to overcome the repulsion of the magnets, but once the system is in place, it is held there in axial direction DA. Such a system is particularly advantageous when it is combined with the introduction of jewels (or any other tribological surface) to minimise friction from radial contact, in the case where the friction is not utilised.

The second case of FIG. 12 is a magnetic recentring system, wherein arbor 10 includes permanent magnets, and is held against a line-shaped structure composed of magnetically attractive parts and repulsive parts. These parts may also be made of permanent magnets. The radial holding of this system is magnetic by means of the attractive parts, with the possible variants presented above; the arbor is recentred magnetically after each shock. This system can easily be adapted for an angular degree of freedom. Such a line-shaped structure with magnetically attractive and repulsive areas may also be directly on arbor 10, with a permanent magnet on the structure connected to a fixed part of the timepiece movement.

Figure 18A:
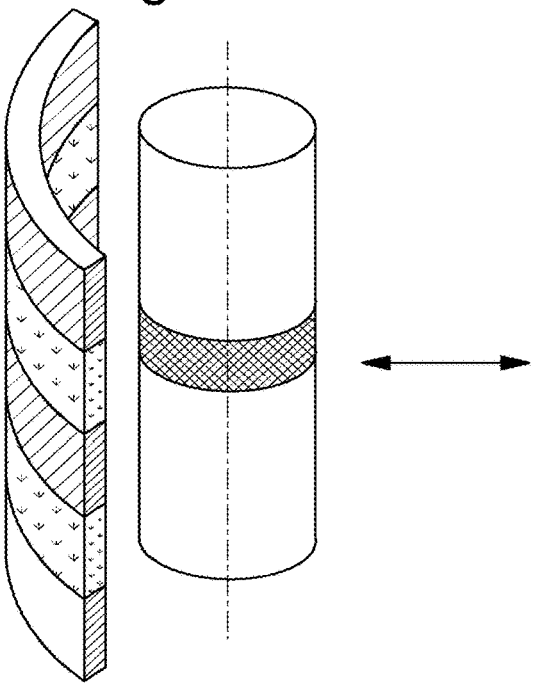
FIG. 18A is a schematic perspective view of a mechanism utilising the system of FIG. 12, with an arbor having, in its median portion, a dark permanent magnet placed in proximity to the line-shaped structure, in the form of a concave shell here with an alternating arrangement of diamagnetic and paramagnetic/ferromagnetic areas.
Figure 18B:
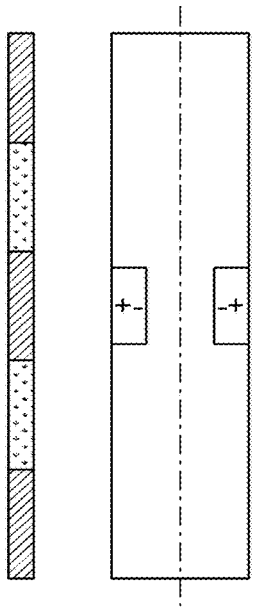
FIG. 18B is a cross-sectional view of the assembly of FIG. 18A.
Figure 18C:
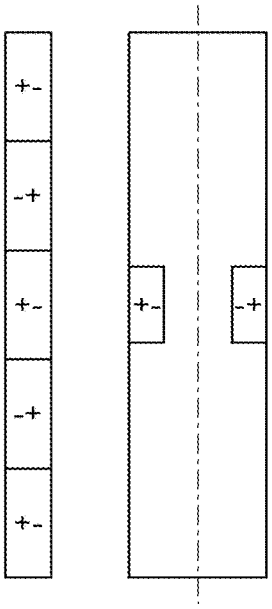
FIG. 18C illustrates the polarities generated by the presence of the permanent magnet, fixed to the arbor, and by the magnetic properties of areas on the shell; the arbor provided with a permanent magnet is then subjected to a force similar to the versions of FIGS. 10 to 12, but generated by the diamagnetic and paramagnetic/ferromagnetic areas.

FIGS. 18A, 18B, 18C represent a mechanism utilising the system of FIG. 12. FIGS. 18A and 18B represent an arbor with a permanent magnet placed in proximity to the line-shaped structure, in the form of a shell here (not necessarily of revolution), which includes an alternating arrangement of diamagnetic and paramagnetic/ferromagnetic parts. FIG. 18C illustrates the polarities generated by the presence of the permanent magnet (fixed to the arbor) and by the magnetic properties of areas on the shell. The arbor provided with a permanent magnet is then subjected to a similar force to the versions of FIGS. 10 to 12, but this force is generated here by diamagnetic and paramagnetic/ferromagnetic areas.

Figure 19A:
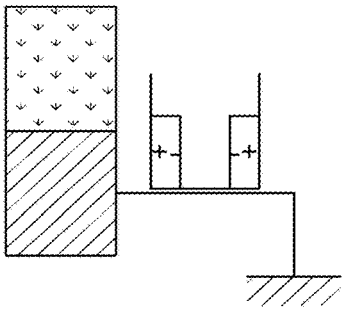
FIGS. 19A and 19B are similar to FIGS. 18B and 18C, but for a system utilising retention in mechanical contact, the portion represented in cross-hatching being stationary.
Figure 19B:
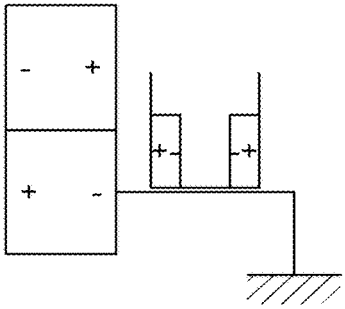

FIGS. 19A and 19C are similar to FIGS. 18B and 18C, but for a system utilising a retention in mechanical contact, the part shown in cross-hatching being fixed.

Returning to FIG. 10, the magnets of one of the two components (arbor or sleeve) are preferably of revolution to ensure proper operation of the arbor in rotation. As regards the anti-shock function, the response of the system is not isotropic, if the magnets are not of revolution. This is not necessarily inconvenient, insofar as it is only a transitional phase, and other configurations can thus be envisaged:

- the arbor magnets are of revolution (and not those of the sleeve) so the direction in which the anti-shock function is maximum is fixed on the movement, this direction may correspond, for example, to a direction that statistically receives more shocks;
- the magnets of the sleeve are of revolution (and not those of the arbor), so the direction in which the anti-shock function is maximum is fixed on the arbor; this direction may correspond to one direction in which the radial position of the arbor must be better efforted than the other (for example due to the presence of a fixed component on the arbor which is not symmetrical in revolution and which would collide with another component of the movement);
- one of the above two configurations, but wherein the magnets that are not of revolution are no longer located on either side; thus, retaining mechanical contact on one side ensures the radial positioning of the arbor.

These solutions allow more an axial positioning (with mechanical guiding for the radial part) than radial positioning, since they work by attraction. This property makes them unstable if they are used for radial centring.

The variants of FIGS. 14 to 17 are provided for radial recentring using repulsion, with axial stop positioning by means of the magnetic force. The variant with axial end magnetic attraction (not shown) is particularly advantageous.

The variant that operates using magnetic attraction has the drawback of imprecise radial centring: the arbor is in mechanical contact on one of the walls of the sleeve—a wall that may vary during the function—but this variant also allows the arbor to be axially pressed against a stop with a return force that depends on the position of the arbor in its sleeve. A variant with magnets that are not of revolution, similar to FIG. 1, allows the arbor to always be radially pressed on the same face, and the position of the arbor is thus less variable.

Another variant consists in adding a front magnet onto the fixed structure, to assist in axial holding of the arbor at one of the ends.

Another variant, with a force that decreases rather than increases with the displacement of the arbor in the sleeve, makes it possible to obtain a strong holding force, and the contribution of the magnetic force decreases with shocks of greater amplitude (where a stop takes over).

Various different types of magnetic potential profiles may be envisaged, and in particular a stepped variant, where more and more energy is absorbed as the arbor moves towards its stop. Another variant comprises real barriers, which technically only temporarily absorb energy, since the energy is restored as soon as the arbor leaves the barrier area.

Although the variant represented in FIG. 14 concerns a structure, inside which the arbor can move, which includes a series of areas generating conical fields, tending to oppose the fields generated by the arbor, and which, from an operating position of the arbor, are of gradually increasing intensity as they approach the lower part of the travel of the arbor, it is understood that other variants may concern:

- a series of areas generating fields that tend to align on the fields generated by the arbor;
- and/or fields of decreasing intensity towards the lower part of the travel of the arbor.

The configuration where the magnetic force depends on the position of the arbor in the sleeve (of increasing intensity during large shocks) is advantageous. In this variant, it is also possible to create a dependency of the magnetic force, in a similar manner to a mechanical spring (increasing as the arbor moves away from its position of equilibrium).

Figure 22:
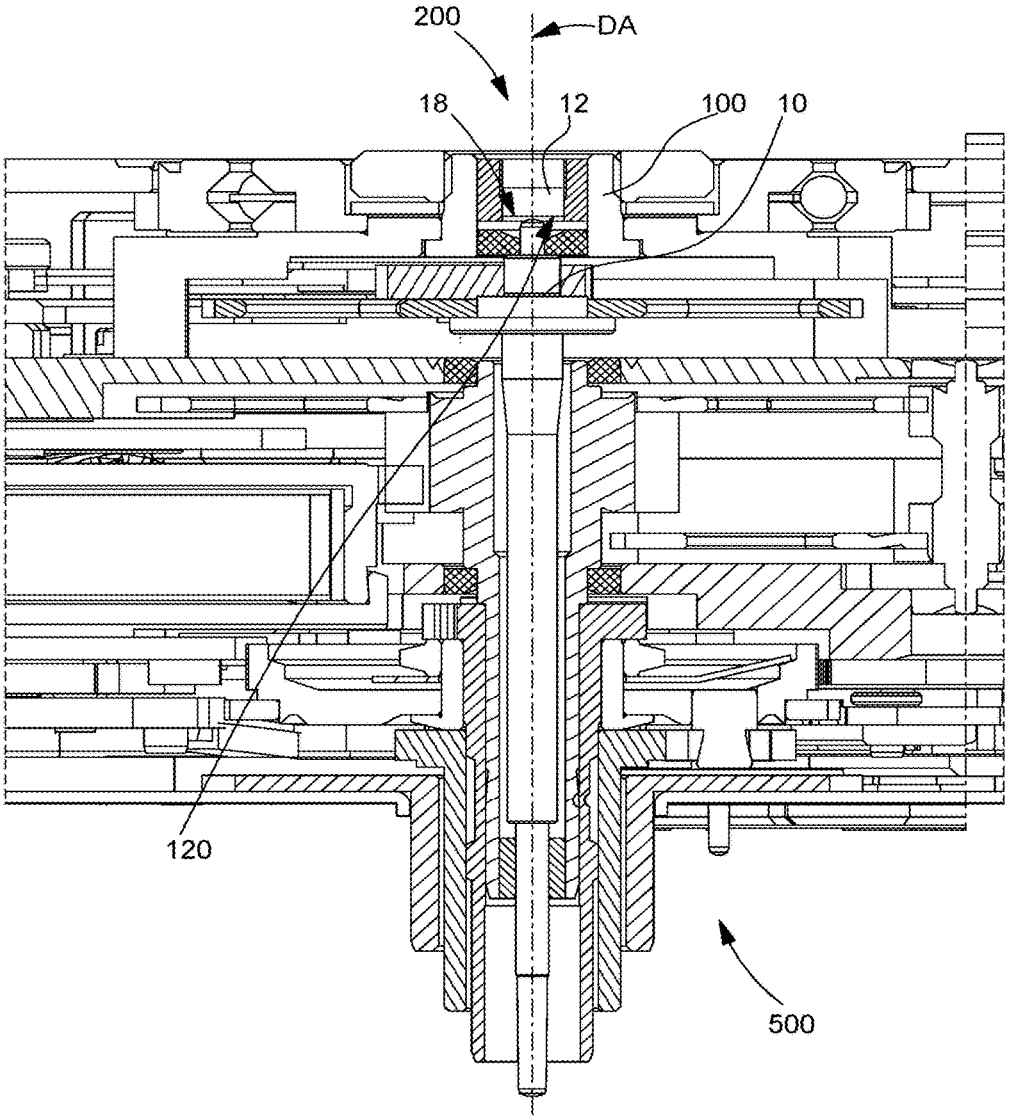
FIG. 22 shows a schematic, partial, cross-sectional view of a timepiece movement comprising a sub-assembly according to the invention, with an arbor axially attracted by a pole piece, and whose end is in friction contact on the front part of the pole piece.

FIG. 22 illustrates the case of an arbor axially attracted by a pole piece, and whose end is in friction contact on the front part of the pole piece.

The lateral holding of FIGS. 1 to 3 is chosen to be partial, to maintain mechanical contact, and thus to utilise the anti-shock concept. For shocks of low amplitude, the arbor, typically a balance staff, does not leave its position (held in a preferred angular direction) and only moves away above a certain threshold. The drawback of the lateral version lies in the increased friction (on the radius of the arbor and not on a reduced friction radius). This friction may however be utilised to dissipate energy, typically to dampen the floating motion of a hand.

Naturally, although in the examples the arbor and the magnet are illustrated in magnetic attraction, it is entirely possible to create the same system in repulsion, which then creates a contact on the opposite side.

In order to protect the exterior of the watch, in particular the user and certain sensitive devices, from the magnetic fields of such a system, and to increase the efficiency of the retention system, it is possible and advantageous, to insert a ferromagnetic shield or to use the case middle as such.

More particularly, the invention concerns a timepiece sub-assembly 200 for watches, comprising a main structure 100 and an arbor 10. This arbor 10 is pivotally movable about an axis of pivoting DA, inside at least one housing 14, 15, of main structure 100.

Arbor 10 comprises at least one surface 16, 18, 21, 22, which is made of a magnetized or magnetically conductive material, or respectively of electrically charged or electrostatically conductive materials. "Magnetic conductive" means here a ferromagnetic or diamagnetic or paramagnetic material.

To cooperate with this arbor 10, main structure 100 includes at least one pole piece 11, 12, 31, 32, which is arranged to create, in proximity to at least one such surface 16, 18, 21, 22, at least one magnetic field or respectively one electrostatic field, for the axial and/or magnetic holding of arbor 10 with respect to axis of pivoting DA.

In the case of axial holding of arbor 10, this field is substantially of revolution about axis of pivoting DA.

In a variant, main structure 100 comprises at least one pole piece 11, 12, 31, 32, arranged to create, in proximity to at least one such surface 16, 18, 21, 22, in addition to the field intended for axial retention of arbor 10, at least one magnetic field, or respectively one electrostatic field, for radial retention of arbor 10.

More particularly, this fields ensure both the axial and radial retention of arbor 10.

According to the invention, at least one such pole piece 11, 12, 31, 32, is arranged to cooperate in axial and/or radial attraction or repulsion, along axis of pivoting DA, with at least one such surface 16, 18, 21, 22, to absorb a shock and return arbor 10 to the operating position after the shock ceases.

According to the invention, at least one pole piece 11, 12, 31, 32 is arranged to create, in proximity to at least one such surface 16, 18, 21, 22, at least one such magnetic field, or respectively electrostatic field, which tends to radially attract arbor 10 towards a wall of housing 14, 15.

In another variant, the field thus crated varies along axis of pivoting DA and is arranged to apply to arbor 10 a resistive effort resulting from the cooperation in magnetic attraction or repulsion between at least one pole piece 11, 12, 31, 32, and at least one surface 16, 18, 21, 22.

More particularly, at least one such pole piece 11, 12, 31, 32 is arranged to cooperate in axial attraction or repulsion, along axis of pivoting DA, with at least one such surface 16, 18, 21, 22, to hold arbor 10 in an axial operating position, in the absence of any shock or external disturbance.

More particularly, at least two pole pieces 11, 12, 31, 32, cooperate, in geometric opposition, with at least two corresponding surfaces 16, 18, 21, 22, to exert on arbor 10 opposite and equal axial efforts. It is understood that, in the normal operating position, not all the surfaces of arbor 10 necessarily have to cooperate with all the pole pieces of main structure 100; indeed, the relative cooperation between certain surfaces and certain pole pieces only exists in certain relative axial positions of arbor 10 with respect to main structure 100.

Of course, the surfaces of the arbor may be pole pieces arranged to create such a magnetic field, or respectively such an electrostatic field, just as certain pole pieces of the structure may comprise surfaces made from a magnetized or magnetically conductive material, or respectively from an electrically charged or electrostatically conductive material: both arbor 10 and main structure 100 may comprise areas generating fields, and/or passive areas reacting to a magnetic and/or electrostatic field.

In a variant of the invention, in the magnetic application, the axial component, along axis of pivoting DA, of the resulting magnetic field, ensuring the axial anti-shock attraction or repulsion, preferably has an intensity greater than 0.55 Tesla, in the case of a steel arbor with a mass of 60 mg.

The electrostatic application requires fields that limit its application to arbors of very small mass, much less than 60 mg, and notably less than 10 mg.

In a particular embodiment, which minimises friction, at least one magnetic field, or respectively electrostatic field, tends to radially attract or repel arbor 10 at a distance from the walls of housing 14, 15, and to align arbor 10 on axis of pivoting DA. More particularly, at least one of these pole pieces 11, 12, 31, 32, is arranged to create such a field, in proximity to at least one such surface 16, 18, 21, 22.

In another variant, at least one magnetic or respectively electrostatic field tends to radially attract arbor 10 towards one wall of housing 14, 15. More particularly, at least one of these pole pieces 11, 12, 31, 32, is arranged to create such a field, in proximity to at least one such surface 16, 18, 21, 22.

In an advantageous implementation, arbor 10 is axially braked along axis of pivoting DA only by a magnetic or respectively electrostatic potential, which varies along axis of pivoting DA and creates a resistive effort resulting from the cooperation in attraction or repulsion between at least one pole piece 11, 12, 31, 32, and at least one surface 16, 18, 21, 22.

More particularly, the profile of this potential is such that the resistive effort continuously increases or decreases during the travel of arbor 10 along axis of pivoting DA.

More particularly, in order to ensure the transformation of the kinetic energy communicated to arbor 10 upon an acceleration or shock, arbor 10 is braked axially along axis of pivoting DA only by this potential profile which forms at least one magnetic, or respectively electrostatic field barrier, resulting from the cooperation in attraction or repulsion between at least one pole piece 11, 12, 31, 32, and at least one said surface 16, 18, 21, 22. This barrier forms a virtual annular catch, arranged to brake or stop the travel of arbor 10 along axis of pivoting DA. Crossing such a barrier absorbs part of the kinetic energy of arbor 10 in the event of a shock. Depending on the configuration of the potential profile, this energy is restored if the barrier forms a potential peak between an increasing ramp and a decreasing potential ramp, or accumulated if the potential profile is stepped, or saw-tooth, with stages that are each limited by one such potential barrier.

More particularly, arbor 10 is braked axially along axis of pivoting DA only by a plurality of such barriers; the crossing of each barrier absorbs part of the kinetic energy of a shock, each barrier thus forming the boundary of a potential level.

More particularly still, these barriers are in succession and, along axis of pivoting DA, have magnetic or respectively electrostatic field intensities that increase, from an operating position of arbor 10, towards a mechanical stop comprised in main structure 100, forming an end-of-travel for the end of arbor 10 concerned.

In a variant, this mechanical stop is twinned with a magnetic stop, or itself forms a magnetic stop.

In a particular embodiment, arbor 10 is cylindrical.

In a particular embodiment, at least one housing 14, 15 of main structure 100 is cylindrical. More particularly, main structure 100 comprises a single bore for housing arbor 10.

In a variant for lateral insertion of arbor 10, main structure 100 comprises a lateral cutout 19 extending parallel to axis of pivoting DA, and dimensioned to allow the lateral insertion and removal of arbor 10.

In a variant for axial insertion of arbor 10, main structure 100 includes an end cutout 190 dimensioned to allow the insertion and removal of arbor 10 along axis of pivoting DA.

In a particular variant, main structure 100 comprises a first structure 11 comprising at least a first housing 14. Arbor 10 is pivotally movable at least inside first housing 14. This first structure 11 creates, inside first housing 14, one such magnetic field or respectively one such electrostatic field, substantially of revolution about axis of pivoting DA, to subject arbor 10 to a effort tending to align arbor 10 along axis of pivoting DA. Main structure 100 comprises, in a second housing 15 arranged on first structure 11 or on second structure 12 comprised in main structure 100, a magnetized or respectively electrically charged banking surface 120, arranged to axially attract or repel, along axis of pivoting DA, a magnetized or respectively electrically charged front surface 18 comprised in arbor 10. In the magnetic variant, the magnetic field intensity, between front surface 18 and banking surface 120 is greater than 0.55 Tesla, for a steel arbor with a mass of 60 mg.

More particularly, this at least one front surface 18 is of revolution about an arbor axis AA of arbor 10, which is aligned with axis of pivoting DA, when arbor 10 is in first housing 14.

More particularly, arbor 10 comprises two such front surfaces 18 opposite each other, and timepiece sub-assembly 200 comprises two said banking surfaces 120, each arranged to attract or repel one such front surface 18.

More particularly, arbor 10 comprises at least one such front surface 18 at a distal end along an arbor axis AA of arbor 10 which is aligned with axis of pivoting DA when arbor 10 is in first housing 14.

More particularly, arbor 10 comprises one such front surface 18 at each of its distal ends along arbor axis AA.

In a particular variant, arbor 10 comprises at least a first upper shoulder 16, housed inside first housing 14 and comprising, at least at the surface thereof, a magnetized or ferromagnetic material, or respectively comprising, at least at the surface thereof, an electrostatically conductive material. This at least one first upper shoulder 16 is subjected, in first housing 14, to the magnetic field or respectively electrostatic field generated by first structure 11. Arbor 10 comprises at least a second lower shoulder 17 housed inside a second housing 15 comprised in structure 11 or comprised in a third structure 13 of timepiece sub-assembly 200, said second housing 15 forming a stop, particularly a radial stop.

More particularly, second housing 15 surrounds a second structure 12 comprising one such banking surface 120.

More particularly, arbor 10 is of revolution about an arbor axis AA of arbor 10, which is aligned with axis of pivoting DA, when arbor 10 is in first housing 14. Arbor 10 comprises at least a first cylindrical upper shoulder 16 which cooperates with a bore of revolution forming first housing 14.

The invention also concerns a movement 500 including at least one such timepiece sub-assembly 200.

The invention also concerns a watch 1000 including at least one such timepiece sub-assembly 200.

In a particular embodiment, the structure is made of ceramic, and comprises, at least in proximity to the surface of at least one housing 3, an inlaid arrangement of magnets and/or electrets, and/or magnetizable ferromagnetic particles.

In particular, housing 3 is smooth.

In particular, structure 1 comprises or forms a ferromagnetic shield.

If the invention is compared to prior art embodiments incorporating magnetic elements in guide members, there is known from the ETA 2894 calibre the use of a magnet to brake a small seconds wheel set, in the form of friction to remove floating: in that case the magnetic interaction is used only to dissipate the energy of the wheel set, without ensuring the centring of the rotating wheel set. The anti-shock configuration according to the invention differs therefrom, in that:

- the relative position of the magnet and of the ferromagnetic part of the rotating wheel set is rotation invariant, thereby avoiding variations in torque arising from this asymmetry;
- the purely mechanical contacts have a minimum contact surface and provide effective tribology, thereby minimising the dissipation of energy, and thus the torque taken up;
- in some variants, a mechanical stop is only used in the event of shocks, while the magnetic field ensures the recentring of the wheel set after a shock regardless of the amplitude of the shock: the mechanical and magnetic forces thus act separately.

Another ETA calibre uses magnets to angularly position a time zone system. In that case, the magnetic configuration imposes a finite holding torque (threshold effect) which opposes angular displacements. The present invention is intended for a function which is the exact opposite: the magnetic configuration is defined to impose a radial and/or axial retaining/recentring force without introducing a retaining or angular braking torque. In this manner, the wheel set is free to rotate, yet its centring is ensured. Referring to FIG. 12, a fundamental feature of the invention, in the case of axial retention, is the cylindrical symmetry of the magnetic system.

The presence of magnetic attraction is one of the characteristic aspects of the invention, in comparison to systems that instead incorporate repelling magnets.

For example, in a system utilising magnetized parts working only in magnetic repulsion to generate magnetic suspension the exact position of the component is thus not known precisely over time, and it is possible, and even inevitable, for the component to oscillate about a position of equilibrium, generating friction where there is a mechanical contact, and causing operating problems if the amplitude of oscillation is too high. While, within the scope of the invention, in most applications, the magnetic force is used to press the arbor against a mechanical stop with a certain prestress force. In normal operation, the component is thus in a mechanically fixed constant position.

Known mechanisms do not utilise the magnetic properties of a component whose magnetic parts are merely appendages, precisely because magnetic attraction arrangement is always avoided.

The use of magnetic properties according to the invention in an anti-shock function departs from known magnetic applications, which are centred on levitation or positioning centring, and in which positioning is very sensitive to tolerances (the geometry of the magnets and remanent fields).

Indeed, the dissipation of energy from the shock is not optimum with a magnetic system, which is highly conservative, and which requires the use of mechanical stops. In the invention, recentring (for example radial recentring in the case of FIG. 9) is a secondary effect of the (axial) anti-shock system.

FIGS. 10 and 11 represent variants wherein the different magnetic fields present are not coaxial and the interactions between components may, in particular, be oblique.

The operation of a system according to the invention, with magnets maintaining a mechanical contact, makes insensitivity to the tolerances of the magnet possible (as regards positioning).

The main advantage of the magnetic anti-shock system for an arbor is the dependency of the return force on the displacement of the arbor, in the axial direction, for example. Just as in a conventional anti-shock system, a prestress force, or a contact maintaining force in the case of the magnetic anti-shock system, forces the component not to move in the event of low level shocks. Beyond this shock amplitude, the return force of a conventional anti-shock system increases as the component moves away, due to the loading of the spring, whereas that of a magnetic anti-shock system according to the invention decreases as the component moves away. This feature actually enables two different regimes to be uncoupled: the first where shocks are of low amplitude, and the second where shocks are of higher amplitude, with a shock level value beyond which the energy is stored mechanically or dissipated, by a stop for example.

In practice, there is often observed a prestress force which varies greatly with tolerances. Assigning this prestress force to the magnetic force makes it possible to only depend on the mechanical spring for its rigidity during damping beyond a given shock amplitude (large shocks).

The invention is characterized by various advantages:

- to avoid variations in torque due to any asymmetry, the relative position of the magnet and of the ferromagnetic part of the arbor may be designed to be rotation invariant;
- purely mechanical contacts can be minimised, as a result of the magnetic or electrostatic axial retention, in particular in the configuration using magnetic repulsion and no stops, and, in the case where these mechanical contacts are retained, they have a minimum surface contact and provide effective tribology, minimising the dissipation of energy, and thus the torque taken up.
- these contacts may also be identical or larger than with a conventional friction spring, and can thus utilise the dissipation of energy to dampen the floating of a hand or suchlike;
- in some variants of the invention, a mechanical stop is only used in the event of large shocks, while the magnetic field ensures the recentring of the arbor after the shock, regardless of the amplitude of the shock, and holds the arbor in position during low level shocks: the mechanical and magnetic efforts thus act separately;
- the magnetic and/or electrostatic configuration is defined to impose a radial and/or axial holding/recentring effort, without introducing a holding or angular braking torque into the system. In this manner, the arbor is free to rotate, and its centring is ensured. An advantageous feature of some variants of the invention is the cylindrical symmetry of the magnetic system about axis of pivoting DA;
- dependency with respect to tolerances is lower than in the prior art;
- problems linked to wear due to shocks suffered by the watch are very significantly reduced, since they only concern the rare cases where the arbor comes into contact with a mechanical stop in the case of the highest shocks;
- cooperation between the fields ensures fine recentring after a shock;
- the highly elastic response of the magnetic fields allows for better control of friction;
- the variants presented allow axial and radial effort to be detached and treated separately;
- it is henceforth possible to secure any arbor in a movement using magnetic or electrostatic efforts;
- it is possible to treat shocks of different amplitudes in a different way, by utilising different components (or parts of components) to dissipate energy. It is possible to envisage a threshold below which magnetic force is used, and above which dissipation is mechanical.

Magnetic variants of timepiece embodiments operate correctly with an axial field of 0.55 Tesla.

A particular embodiment example concerns a steel arbor with a mass of 60 mg, held in contact by a magnet, by magnetic attraction, and with an axial field of 0.55 Tesla, the arbor has a diameter (for the part close to the magnet) of 0.15 mm, with NeFeB magnets having a remanence of 1.47 T, and is pressed with sufficient holding force to resist shocks with accelerations of less than 75 g if the magnet has a height of 0.8 mm and a radius of 0.45 mm; the calculation takes account of the presence of a tribological layer with a thickness of 60 μm between the arbor and the magnet. A typical magnetic potential variation between the mechanical stop and the operating position contact is 6 μJ for 0.1 mm of displacement, particularly in the case of this example. With a variation two times greater (0.12 J/m), it is possible, for example, to create two levels of potential, which are utilised in two different shock regimes (0-100 g and 100-200 g).

For the electrostatic variant, for similar applications, provision should be made for between 0.5 and 50 mC/m^2 (a field of around 0.01-1 MV/m).

A system according to the invention can thus be used to replaced a mechanical friction spring. Any mechanical friction produced by this system is not necessarily a disadvantage, and can be utilised, including in the case of radial retention where there is significant friction against the sleeve. Friction can thus be utilised to dissipate energy from a floating mobile element such as a hand.

It is also possible to combine the mechanical friction due to maintaining contact with an eddy current type braking system.

In short, the invention makes it possible to separate functions in the event of shocks, according to the shock amplitude:

- for a system where the arbor is held against a stop, for example by means of unbalanced magnets, the magnetic force keeps the arbor in contact during low shocks but decreases sharply when the shock is sufficiently large for the arbor to move away. It is then a mechanical stop that takes over;
- for a system where the magnetization varies along the axial direction, several values are defined for displacement in this direction according to the intensity of the shock, up to a maximum value where the arbor dissipates the energy remaining on the stop member.

The invention claimed is:

1. A timepiece sub-assembly for watches, comprising:

- a main structure and an arbor pivotally movable about an axis of pivoting inside at least one housing of said main structure,
- said arbor comprising at least one surface made of a magnetized or magnetically conductive material, and
- said main structure including at least one pole piece, which is arranged to create, in proximity to the at least one surface, at least one magnetic field, for at least one of axial or magnetic retention of said arbor, wherein
- the at least one pole piece is arranged to cooperate in axial and radial attraction or repulsion, along said axis of pivoting with the at least one surface, to maintain said arbor in abutment in said housing in an operative position, to allow a trip of said arbor during a shock, to absorb a radial shock and to return said arbor to said operating position after said shock ceases, by holding said arbor in contact on position stops or in contact on permanent magnets,
- the at least one pole piece is arranged to create, in proximity to the at least one surface, the at least one magnetic field, which tends to radially attract said arbor towards a wall of said housing, said main structure comprises a first structure comprising at least a first housing, at least inside which said arbor is pivotally movable, said first structure creating in said first housing said at least one magnetic field, substantially of revolution about said axis of pivoting, to subject said arbor to an effort tending to align said arbor along said axis of pivoting, and said main structure comprises, in a second housing arranged on said first structure or on a second structure comprised in said main structure, a magnetized banking surface, arranged to axially attract or repel, along said axis of pivoting, a magnetized front surface comprised in said arbor, and said arbor includes at least one first upper shoulder housed inside said first housing and comprising at least on a surface thereof a magnetized or magnetically conductive material, said at least one first upper shoulder being subjected, inside said first housing, to said at least one magnetic field, generated by said first structure, and said arbor comprises at least one second lower shoulder housed inside the second housing comprised in said main structure or comprised in a third structure of said timepiece sub-assembly, said second housing forming a stop.

2. The timepiece sub-assembly according to claim 1, wherein the at least one magnetic field ensures said attraction or repulsion of said arbor axially, is substantially of revolution about said axis of pivoting, and is a magnetic field, and wherein an axial component thereof, along said axis of pivoting, has an intensity higher than 0.55 Tesla.

3. The timepiece sub-assembly according to claim 1, wherein said arbor is axially braked along said axis of pivoting only by a magnetic potential, which varies along the axis of pivoting and creates a resistive effort resulting from the cooperation in attraction or repulsion between the at least one pole piece, and the at least one surface.

4. The timepiece sub-assembly according to claim 3, wherein a profile of said potential is such that the resistive effort continuously increases or decreases during a travel of said arbor along the axis of pivoting.

5. The timepiece sub-assembly according to claim 3, wherein said arbor is axially braked along said axis of pivoting by said potential profile which forms at least one magnetic field barrier, said barrier forming a virtual annular catch, arranged to brake or stop the travel of said arbor along said axis of pivoting.

6. The timepiece sub-assembly according to claim 5, wherein said arbor is braked axially along said axis of pivoting only by a plurality of said barriers, a crossing of each barrier absorbs part of a kinetic energy of the shock, each said barrier forming a boundary of a potential level.

7. The timepiece sub-assembly according to claim 5, wherein said barriers are in succession and, along said axis of pivoting, are of increasing magnetic field intensity, from the operating position of said arbor towards a mechanical stop comprised in said main structure.

8. The timepiece sub-assembly according to claim 7, wherein said mechanical stop is twinned with a magnetic stop or forms a magnetic stop.

9. The timepiece sub-assembly according to claim 1, wherein the at least one magnetic field or respectively electrostatic field is a magnetic field, and wherein an intensity thereof between said front surface and said banking surface is higher than 0.55 Tesla.

10. The timepiece sub-assembly according to claim 1, wherein said second housing surrounds said second structure comprising said banking surface.

11. The timepiece sub-assembly according to claim 1, wherein said arbor is of revolution about an arbor axis of said arbor which is aligned with said axis of pivoting when said arbor is inside said first housing, and wherein said arbor comprises at least a first cylindrical upper shoulder that cooperates with a bore of revolution forming said first housing.

12. A movement including at least one timepiece sub-assembly according to claim 1.

13. A watch including at least one timepiece sub-assembly according to claim 1.

14. The timepiece sub-assembly according to claim 1, wherein at least a portion of the at least one pole piece overlaps with the arbor in a radial direction that is perpendicular to the axis of pivoting.

15. The timepiece sub-assembly according to claim 1, wherein said magnetic field creates a magnetic force to effort said arbor in three directions, by holding said arbor in contact inside a triangle that positions said arbor on position stops or directly on permanent magnets.

16. The timepiece sub-assembly according to claim 15, further comprising a radial mechanical guide of said arbor, and a magnet that ensures axial holding, and said magnetic field creates a magnetic force used to effort said arbor in one or two of the three directions, whereas said mechanical guiding is used to limit its movement in the other directions.

17. The timepiece sub-assembly according to claim 16, wherein said radial mechanical guide includes a sleeve in a bore of the first structure, whereas arbor is held axially by a magnet comprised in the second structure.

18. The timepiece sub-assembly according to claim 1, wherein said magnetic field creates a magnetic force to effort said arbor in three directions, by holding said arbor in contact in a female trihedron that positions said arbor, and which also forms a set of position stops, and wherein said timepiece sub-assembly includes magnetic elements which are set back with respect to contact surfaces.

19. The timepiece sub-assembly according to claim 1, wherein said magnetic field creates a magnetic force, and wherein said timepiece sub-assembly includes safety stops to limit excessive displacement, with potential contact areas arranged to limit a travel of said arbor when the magnetic force is too weak to resist to the shock.

* * * * *